US012006929B2

(12) United States Patent
He

(10) Patent No.: US 12,006,929 B2
(45) Date of Patent: Jun. 11, 2024

(54) MULTI-PLUNGER COORDINATED GAS LIFT LIQUID DRAINAGE SYSTEM AND LIQUID DRAINAGE METHOD THEREOF

(71) Applicant: Sichuan Haichelifu Oil and Gas Engineering Technology Service Co., Ltd, Chengdu (CN)

(72) Inventor: Xin He, Shenzhen (CN)

(73) Assignee: Sichuan Haichelifu Oil and Gas Engineering Technology Service Co., Ltd, Chengdu (CN)

( * ) Notice: Subject to any disclaimer, the term of this patent is extended or adjusted under 35 U.S.C. 154(b) by 0 days.

(21) Appl. No.: 18/025,396

(22) PCT Filed: Sep. 8, 2021

(86) PCT No.: PCT/CN2021/117296
§ 371 (c)(1),
(2) Date: Mar. 9, 2023

(87) PCT Pub. No.: WO2022/052963
PCT Pub. Date: Mar. 17, 2022

(65) Prior Publication Data

US 2023/0287879 A1 Sep. 14, 2023

(30) Foreign Application Priority Data

Sep. 10, 2020 (CN) ..... 202010948722.5
Sep. 10, 2020 (CN) ..... 202021971576.X

(51) Int. Cl.
*F04B 47/12* (2006.01)
*E21B 43/12* (2006.01)

(52) U.S. Cl.
CPC ..... *F04B 47/12* (2013.01); *E21B 43/122* (2013.01)

(58) Field of Classification Search
None
See application file for complete search history.

(56) References Cited

U.S. PATENT DOCUMENTS 2,676,547 A * 4/1954 Knox ..... F04B 47/12 417/246
4,211,279 A * 7/1980 Isaacks ..... E21B 43/122 166/70

(Continued)

FOREIGN PATENT DOCUMENTS

CN 1648406 A 8/2005
CN 202381286 U 8/2012

(Continued)

*Primary Examiner* — Connor J Tremarche
*Assistant Examiner* — Geoffrey S Lee

(57) ABSTRACT

A multi-plunger coordinated gas lift liquid drainage system and liquid drainage method thereof, the system operates in a reciprocating manner. A large-section liquid column and a gas column within a tubing is divided into multiple units of liquid columns, plungers and gas columns by a plurality of plungers; the units form a series connection, and the plungers in the tubing move up and down respectively to transfer the liquid load cooperatively. A liquid is drained from a wellbore step by step, and the pressure formed by a small section of liquid column disappears each time a small section of liquid column is drained. The pressure of each stage of gas column thereunder is reduced, and the gas columns are expanded step by step.

3 Claims, 5 Drawing Sheets

(56) References Cited

U.S. PATENT DOCUMENTS

| | | | | |
|---|---|---|---|---|
| 4,531,891 | A * | 7/1985 | Coles, III | F04B 47/02 417/59 |
| 6,170,573 | B1 * | 1/2001 | Brunet | E21B 47/017 166/70 |
| 7,080,692 | B1 * | 7/2006 | Kegin | E21B 43/121 166/372 |
| 8,893,777 | B1 * | 11/2014 | Garrett | E21B 43/121 166/166 |
| 10,161,231 | B2 * | 12/2018 | Harris | F04B 47/12 |
| 11,542,797 | B1 * | 1/2023 | Zahran | E21B 33/10 |
| 2003/0215337 | A1 * | 11/2003 | Lee | F04B 47/12 417/56 |
| 2006/0249284 | A1 * | 11/2006 | Victor | E21B 43/121 166/105 |
| 2008/0230230 | A1 * | 9/2008 | Giacomino | E21B 43/121 166/372 |
| 2009/0038788 | A1 * | 2/2009 | Farris | E21B 27/02 166/53 |
| 2011/0073322 | A1 * | 3/2011 | Smith | E21B 43/121 166/112 |
| 2012/0193091 | A1 * | 8/2012 | Bender | E21B 47/008 166/250.15 |
| 2015/0275633 | A1 * | 10/2015 | Tolman | E21B 23/08 166/253.1 |
| 2017/0183945 | A1 * | 6/2017 | Tolman | E21B 43/13 |

FOREIGN PATENT DOCUMENTS

| | | |
|---|---|---|
| CN | 206016781 U | 3/2017 |
| EP | 2085572 A2 | 8/2009 |

* cited by examiner

MULTI-PLUNGER COORDINATED GAS LIFT LIQUID DRAINAGE SYSTEM AND LIQUID DRAINAGE METHOD THEREOF

FIELD OF THE INVENTION

The present invention relates to the field of exploitation of an oil and natural gas wellbore by mean of gas lift liquid drainage using an energy of its own or an injected gas, and more specifically, relates to a multi-plunger coordinated gas lift liquid drainage system and liquid drainage method thereof.

BACKGROUND OF THE INVENTION

After an oil and natural gas well is put into production, liquids will gradually accumulate in the wellbore over time, the production begin to be affected by the fluid. It is necessary to take reasonable process technology to remove the fluid in the wellbore timely, so as to maintain the normal and stable production of the oil and natural gas well.

A conventional plunger gas lift is one of the conventional liquid drainage process technologies commonly used for oil and natural gas wells, which has the advantage of being capable of discharging liquid by its own energy, without the help of external energy, and the disadvantage that the discharge amount of the liquid is small and it requires a high gas-liquid ratio.

In a conventional plunger gas lift process, the plunger acting as a seal for the tubing string is put into a tubing string of an oil and gas well, a large section of gas column under the plunger lifts the plunger and a large section of liquid column on the plunger from the bottom hole to the wellhead, the combined length of the liquid column and the gas column is equal to the length of the tubing string, the pressure borne by the gas column under the plunger is the combined pressure of the wellhead oil pressure and the liquid column pressure, and the gas column cannot expand sufficiently, therefore it requires a high gas-liquid ratio. However a multi-plunger cooperated gas lift is to place a plurality of plungers in the tubing string, and the plurality of plungers divide the large section liquid column lifted by one plunger in the conventional gas lift and the large section gas column below the one plunger into multiple sections of liquid columns and gas columns, namely: a first-stage consisting of a liquid column, a first-stage plunger and a gas column; a second-stage consisting of a liquid column, a second-stage plunger and a gas column; and a third-stage consisting of a liquid column, a three-stage plunger and a gas column, and so on. The multiple stages in the tubing string are connected in series, and move upward simultaneously. The combined length of the liquid columns and the gas columns of the multiple stages is equal to the length of the tubing string, and the specific number of the stages required is determined according to the well conditions. Obviously, because the liquid column pressure borne by a gas column of an upper stage is much less than that of the large section liquid column, the volume of the gas column will expand and the length of the tubing string section it occupies will increase, the volume (length) of the gas column in an upper stage is greater than that of a lower stage. Comparing with a conventional plunger gas lift under the condition that the total length of the liquid column or columns is the same, the mass of gas required in the multi-plunger gas lift to occupy the same remaining tubing space (length) is much smaller. That is, with each small section of the liquid columns being discharged out of the wellhead, the liquid column pressure formed by the discharged small section disappears, so that the volume of all the small gas columns below the discharged liquid columns will expand therewith, the multi-plunger cooperated gas lift allows the gas to expand sufficiently, the gas expansion energy can be fully utilized, and the required gas-to-liquid ratio is reduced. Under circumstance of a certain gas amount, the multi-plunger cooperated gas lift can discharge more liquid, or under the circumstance of a certain liquid discharge amount, the gas amount required by the multi-plunger cooperated gas lift is greatly reduced. The gas-liquid ratio required by the multi-plunger cooperated gas lift is small, and the liquid discharge amount is big.

SUMMARY OF THE INVENTION

The objective of the present invention is to provide a multi-plunger cooperated gas lift liquid drainage system and a liquid drainage method thereof, so as to solve the technical problems of big gas-liquid ratio, small liquid discharge amount and high energy consumption required by a conventional plunger gas lift liquid drainage process in the prior art.

In order to achieve the above mentioned object, the present invention provides the following technical solutions:

The multi-plunger cooperated gas lift liquid drainage system provided by the present invention comprises a tubing string and a plurality of plungers arranged in the tubing string successively from top to bottom, wherein a wellhead poke rod is arranged at a top of the tubing string, a tubing stop is arranged at a bottom of the tubing string.

Each of the plurality of plungers comprises a valve body, a cavity fluidly communicated with a lower end of the valve body, a valve spool disposed in the cavity, and a valve stem passing through a bottom wall of the cavity and fixedly connected to a lower end of the valve spool.

A through hole penetrating through an upper wall of the valve body and formed in the valve body, wherein a lower end of the through hole is fluidly communicated with a valve seat hole, the valve seat hole penetrates through the lower end of the valve body.

Optionally or preferably, a wall of the cavity is provided with at least one screen aperture.

Optionally or preferably, a lower wall of the cavity is provided with a valve stem hole.

Optionally or preferably, the valve stem hole and the valve seat hole are disposed concentrically.

Optionally or preferably, a shape and size of the valve spool is matched with the valve seat hole, so that the valve spool fits with the seat hole well.

Optionally or preferably, an out surface of the valve spool is provided with a blind via, an anti-disengagement spring is provided in the blind via, and an end of the anti-disengagement spring is provided with an anti-disengagement boss.

Optionally or preferably, an inner surface of the valve seat hole is provided with an anti-disengagement hole matching with the anti-disengagement boss to prevent the valve spool from falling off.

Optionally or preferably, the number of the anti-disengagement spring is not limited.

The present invention provides a liquid drainage method of the multi-plunger cooperated gas lift liquid drainage system, the liquid drainage method of the multi-plunger cooperated gas lift liquid drainage system comprises the following steps:

Step 1: installing a tubing stop on a lower portion of the tubing string in a well; opening the well for allowing liquid and gas to accumulate at a bottom of the tubing string; dropping a first plunger having a first valve spool in an open position into the tubing string, wherein the first plunger falls through an accumulated liquid while the accumulated liquid is flowing to an upper portion of the first plunger, collides with the tubing stop to close the first valve spool, the first plunger gets itself sealed when the first valve spool is closed, and then the first plunger and an upper accumulated liquid thereon will be pushed upward by the gas accumulated at the bottom of the tubing string;

Step 2: when the first plunger rising to a first certain height, dropping a second plunger having a second valve spool in an open position into the well, wherein the second plunger falls through the upper accumulated liquid on the first plunger to collide with the first plunger, causing the first valve spool to be opened, the second valve spool to be closed, the upper accumulated liquid on the first plunger transfer to an upper part of the second plunger, and the second plunger and an accumulated liquid thereon to be pushed upward by a second gas column, the first plunger loses the sealing function due to the first valve spool opened and falls to the tubing stop to reclose the first valve spool under the influence of gravity, a newly formed liquid column at the tubing stop is pushed again to ascend under the action of the gas accumulated at the bottom of the tubing string, and at this moment, two small-section liquid columns are formed in the tubing string and pushed upward by two gas column sections under the sealing effect of the two plungers;

Step 3: when the second plunger rising to a second certain height, dropping a third plunger with a third valve spool in an open position, wherein the third plunger meets the second plunger to transfer a liquid load, close the third valve spool, and open the second valve spool, the third plunger reverses and pushes an liquid column thereon upward, the second plunger reverses and moves downward, and then the second plunger meets the first plunger while the first plunger is going up, again to transfer a liquid load, close the second valve spool, and open the first valve spool, the second plunger reverses and pushes an liquid column thereon upward, the first plunger reverses to move downward, collides with the tubing stop to close the first valve spool, and again pushes a liquid column in the tubing string upward, at this moment, three small-section liquid columns are formed in the tubing string and pushed upward by three gas column sections under the sealing effect of the three plungers;

Step 4: each time when the first plunger rising of the plurality of plungers to a certain height, dropping the second plunger of the plurality of plungers which is next to the first plunger into the tubing string, and so on, until the last plunger of the plurality of plungers rising to a last certain height, liquid loads are sequentially transferred between the plungers, so that multiple liquid column sections and multiple gas column sections are formed in the tubing string and move upward simultaneously; wherein the plurality of plungers is determined according to actual needs of the well;

Step 5: installing a wellhead poke rod at a wellhead of the tubing string; wherein an uppermost plunger moves upward to the wellhead, an accumulated liquid and gas on the uppermost plunger being discharged from the tubing string, collides with the wellhead poke rod to open its valve spool, and falls downward;

Step 6: allowing the uppermost plunger to falls down, wherein the uppermost plunger collides with a plunger below the uppermost plunger and transfer an liquid load, the uppermost plunger again moves upward to push an accumulated liquid thereon and gas above itself out of the tubing string, the plunger below the uppermost plunger falls downward, plungers collide with each other to sequentially transfer liquid loads, by analogy, the system runs reciprocating cycle to discharge an accumulated liquid and gas produced at the bottom of the tubing string, every time a small section of liquid column and gas column are discharged, the gas column pressure of all stages in the tubing string is reduced, and the gas columns expand stage by stage, act as a driving force together with the gas produced at the bottom of the well, to push the liquid column at all stages upward;

Optionally or preferably, the gas at the bottom of the tubing string is a reservoir gas injected from the ground into the bottom of the tubing string through a sleeve continuously.

Optionally or preferably, in the operation steps of the liquid drainage system, the steps may comprise: installing the tubing stop first, dropping all the plungers into the tubing string at one time, installing the wellhead poke rod, and then opening the well for production.

Based on the above mentioned technical solution, at least the following technical effects are achieved by the present invention through the above technical solutions:

(1) According to the multi-plunger cooperated gas lift liquid drainage system and liquid drainage method provided by this disclosure, the liquid drainage system circularly runs in a reciprocating manner, a plurality of plungers respectively move up and down in the tubing string, and work cooperatively to transfer liquid loads therebetween, every time a small liquid column section is discharged, the pressure created by this liquid column disappears, the gas column pressure of all stages below the discharged liquid column is reduced, the gas columns expand step by step, the gas expansion can accelerate the ascending motion of the plungers and the liquid columns above the plungers, such that the gas expansion energy can be fully utilized, the required gas-liquid ratio is reduced, the liquid discharge amount increases, more liquid can be discharged under the condition that the gas amount is the same, or the gas amount required by the liquid discharging system is greatly reduced under the condition that the liquid discharging amount is the same.

(2) According to the multi-plunger cooperated gas lift liquid drainage system and liquid drainage method provided by the disclosure, a plurality of plungers are placed in the tubing string, and divide a large-section gas column lifted by a large-section liquid column in conventional gas lift process with one plunger into a plurality of small-section liquid columns and small-section gas columns which are connected in series, that is, the liquid loads are distributed on the plurality of plungers, the whole gas column for pushing the plurality of plungers and the liquids on the plurality of plungers is divided into small gas columns below the plurality of plungers, the plurality of plungers move up and down cooperatively in the tubing string to transfer liquid loads, the liquid columns are discharged step by step, and the gas columns under the plungers are subjected to pressure reduction step-by-step, so that step-by-step expansion is achieved, and therefore the purpose of reducing the gas-liquid ratio is achieved, and meanwhile, continuous production of the gas/oil well is achieved.

(3) Compared with a conventional plunger gas lift, the multi-plunger collaborated gas lift liquid drainage system and the liquid drainage method provided by the invention have the advantages that gas can be fully expanded, gas expansion energy is fully utilized, the required gas-liquid ratio is reduced, and the descent amplitude can reach 30%~70%. In the case of a certain gas amount, the liquid drainage system can discharge more liquid amount, or the amount of gas required by the liquid drainage system is greatly reduced when the liquid discharge amount is the same. Compared with the bubble liquid drainage process, the multi-plunger cooperated gas lift does not need to manually fill the foaming agent, and the defoaming treatment for the discharge liquid is no longer needed. At the same time, the gas-to-liquid ratio required by the multi-plunger cooperated gas lift is small, and the liquid discharge amount is big. Therefore, the problems of big gas-liquid ratio, small liquid discharge amount, high energy consumption and the like required for the working of the foam liquid drainage process can be solved.

Figure 1:
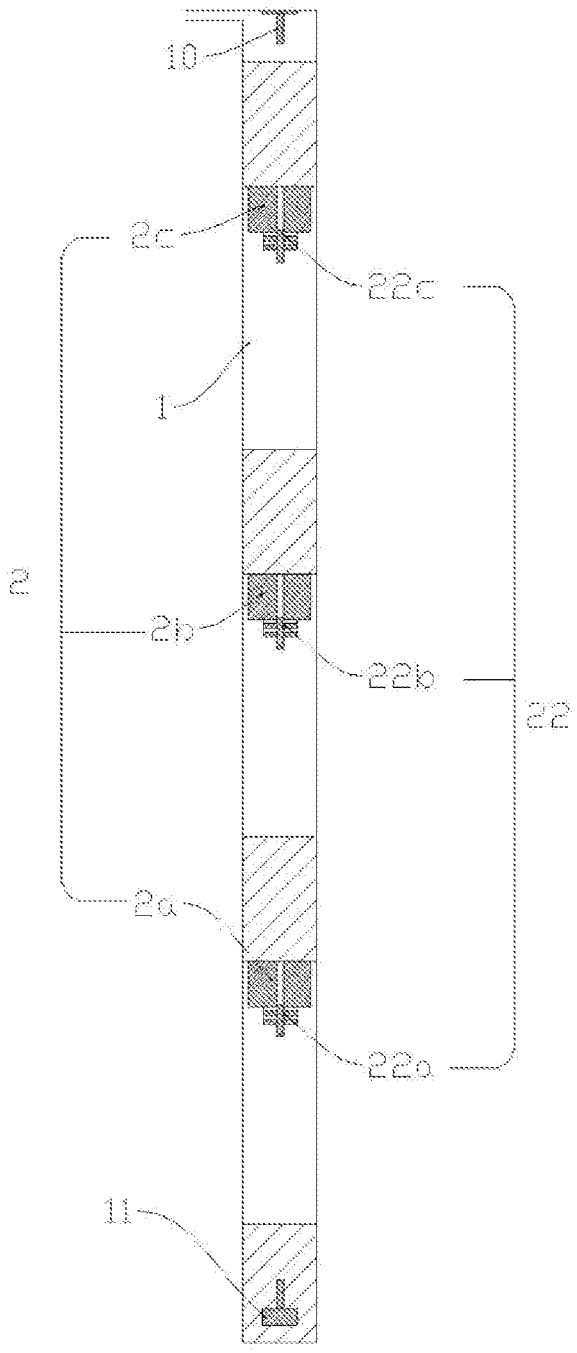
FIG. 1 is a schematic diagram of a multi-plunger collaborated gas lift liquid drainage system of the present invention.

The element labels according to the exemplary embodiment of the present disclosure shown as below: tubing string 1, wellhead poke rod 10, tubing stop 11, plunger 2, first plunger 2*a*, second plunger 2*b*, third plunger 2*c*, valve body 20, through hole 201, valve seat hole 202, anti-disengagement hole 2021, cavity 21, screen aperture 211, valve stem hole 212, valve spool 22, first valve spool 22*a*, second valve spool 22*b*, third valve spool 22*c*, anti-disengagement spring 221, anti-disengagement boss 222, blind via 223, valve stem 23.

DETAILED DESCRIPTION OF PREFERRED EMBODIMENTS

Embodiment of Invention

In order to make the objectives, technical solutions and advantages of the present disclosure more clear, the technical solutions of the present disclosure will be described in detail below. Obviously, the described embodiments are only a part of the embodiments of the present invention, but not all of the embodiments. All other embodiments obtained by a person of ordinary skill in the art based on the embodiments of the present disclosure without creative efforts shall fall within the protection scope of the present disclosure.

"An embodiment" or "embodiments" referred herein refers to a particular feature, structure, or characteristic that may be included in at least one implementation of the present disclosure. In the description of the present disclosure, it should be understood that the orientation or positional relationship indicated by the terms "upper", "lower", "left", "right" and the like is based on the orientation or positional relationship shown in the drawings, and is merely intended to facilitate the description of the present invention and to simplify the description rather than indicate or imply that the indicated device or element must have a specific orientation constructed and operated in a specific orientation, and therefore it should not be understood as a limitation to the present invention. In addition, the terms "first" and "second" are used for descriptive purposes only and are not to be construed as indicating or implying relative importance or implicitly indicating the number of technical features indicated. Thus, the features defined with "first" and "second" may explicitly or implicitly include one or more of the features. Moreover, the terms "first", "second" and the like are used to distinguish similar objects and do not have to be used to describe a particular order or sequence. It should be understood that the numbers used in this way can be interchanged under appropriate circumstances so that the embodiments of the invention described herein can be implemented in an order other than those illustrated or described herein.

Embodiment 1

Figure 2:
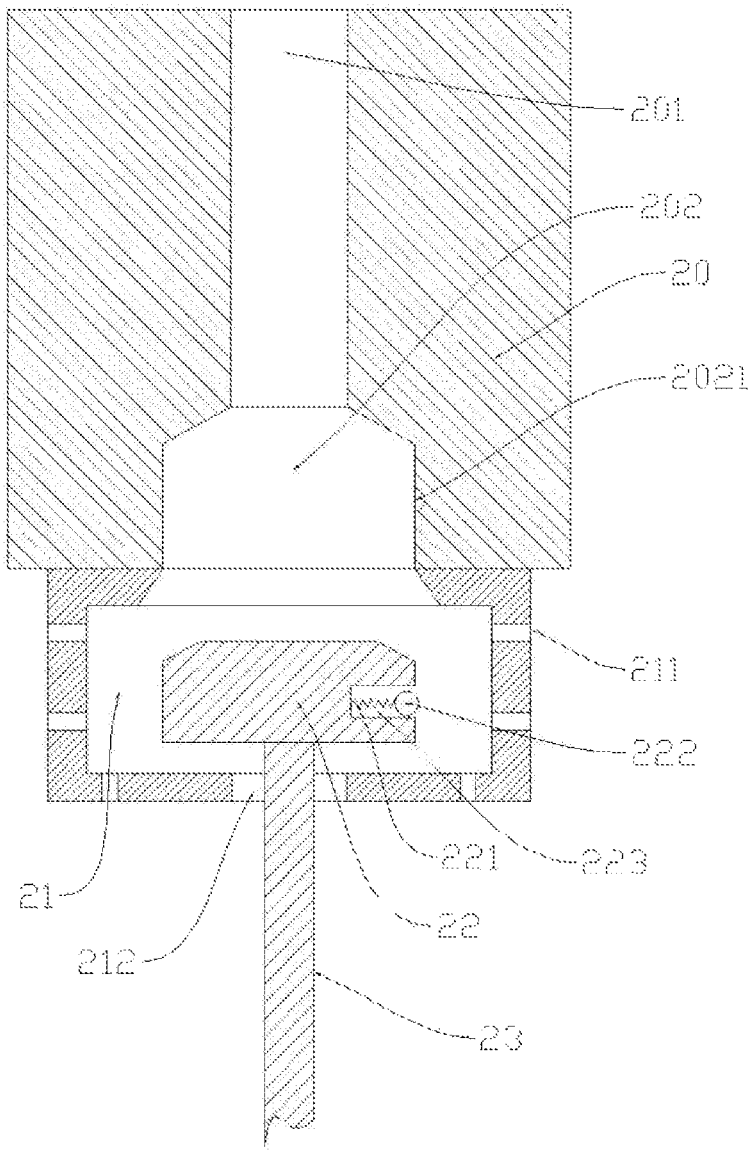
FIG. 2 is a schematic diagram of a plunger structure of the present invention.
Figure 3:
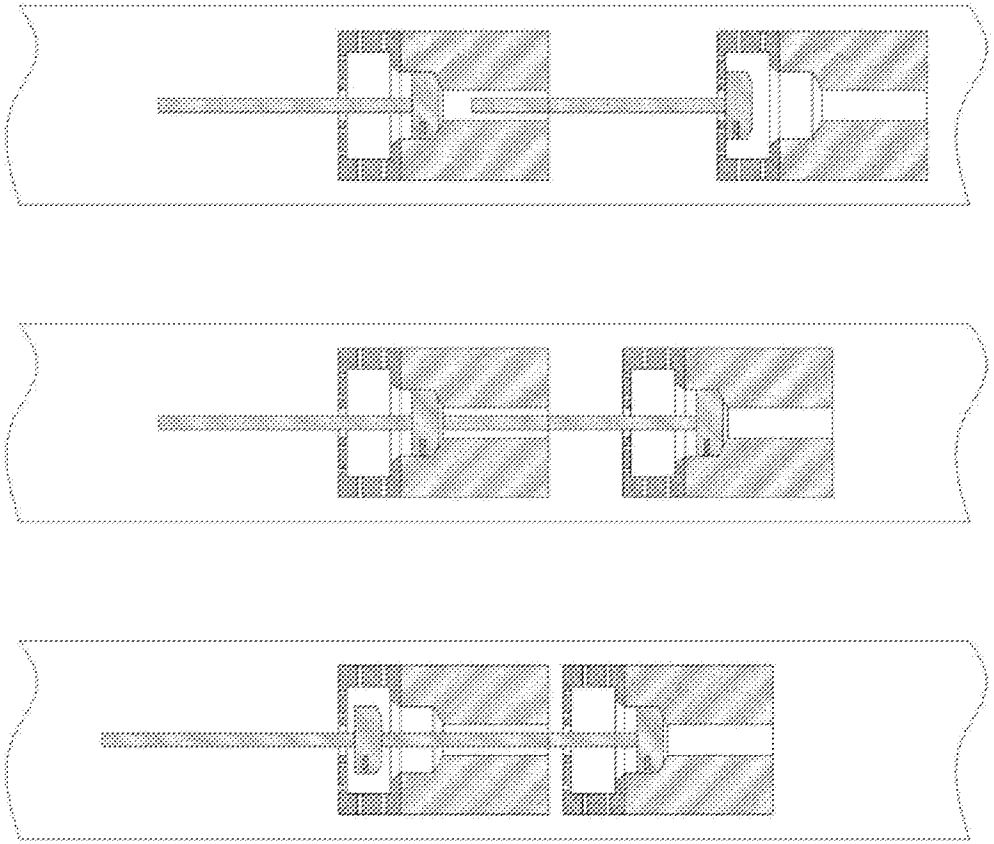
FIG. 3 is a schematic diagram of a process of load transferring between an upper plunger and a lower plunger of the present invention.

As shown in FIGS. 1-3.

The embodiment provides a multi-plunger cooperated gas lift liquid drainage system comprises a tubing string 1 and a plurality of plungers 2 sequentially arranged in the tubing string 1 from the top to the bottom, wherein the top of the tubing 1 is provided with a wellhead poke rod 10, and the bottom of the tubing 1 is provided with a tubing stop 11.

The plunger 2 comprises a valve body 20, a cavity 21 fluidly communicated with the lower end of the valve body 20, a valve spool 22 disposed in the cavity 21, and a valve stem 23 fixedly connected to the lower end of the valve spool 22 and passing through the lower wall of the cavity 21.

A through hole 201 penetrating through the upper wall of the valve body 20 is formed in the valve body 20, the lower end of the through hole 201 is fluidly communicated with a valve seat hole 202, and the valve seat hole 202 penetrates through the lower wall of the valve body 20.

The wall of the cavity 21 is further provided with a plurality of screen apertures 211.

The lower wall of the cavity 21 is provided with a valve stem hole 212.

Figure 4:
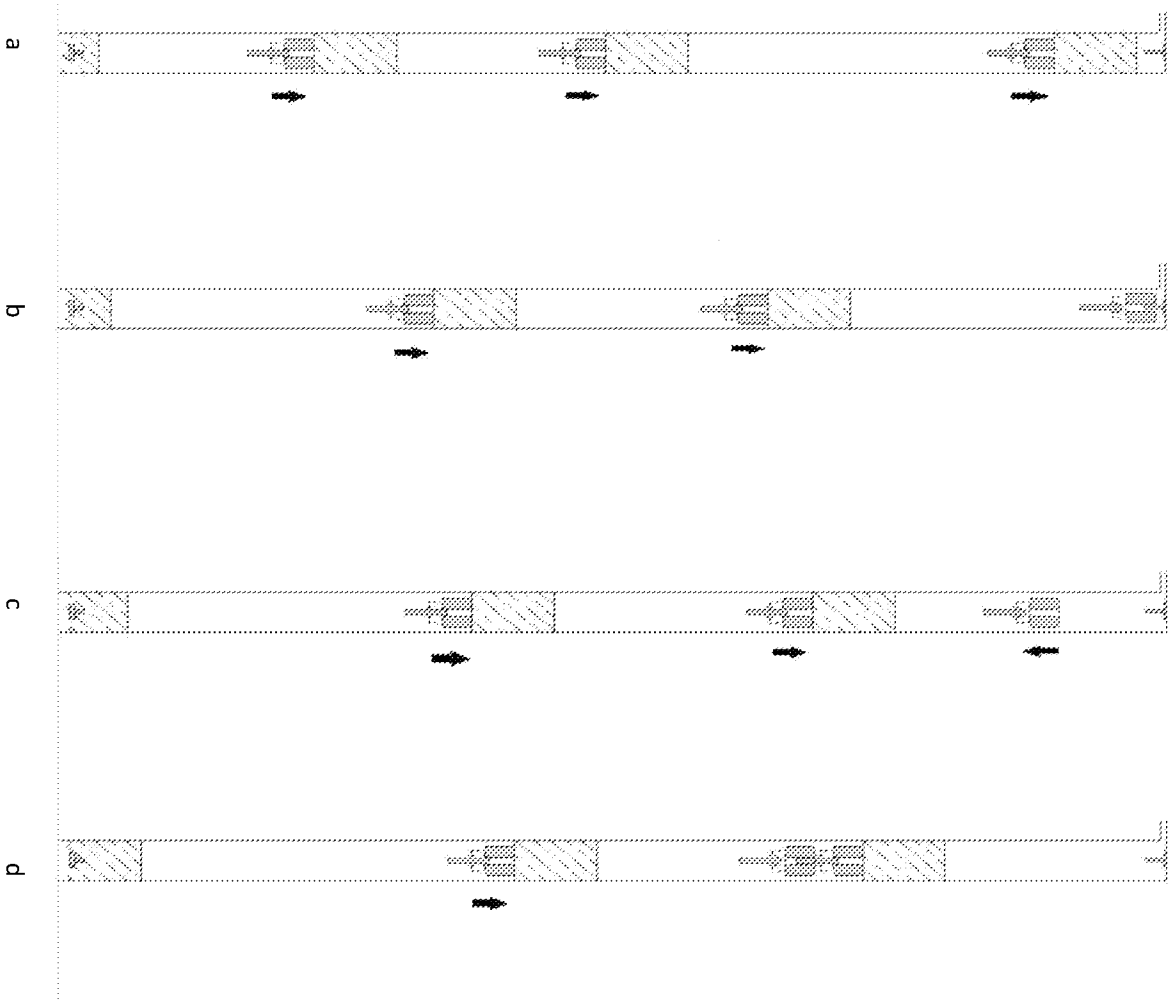
FIG. 4 is a schematic working diagram of a liquid drainage system of the present invention.
Figure 5:
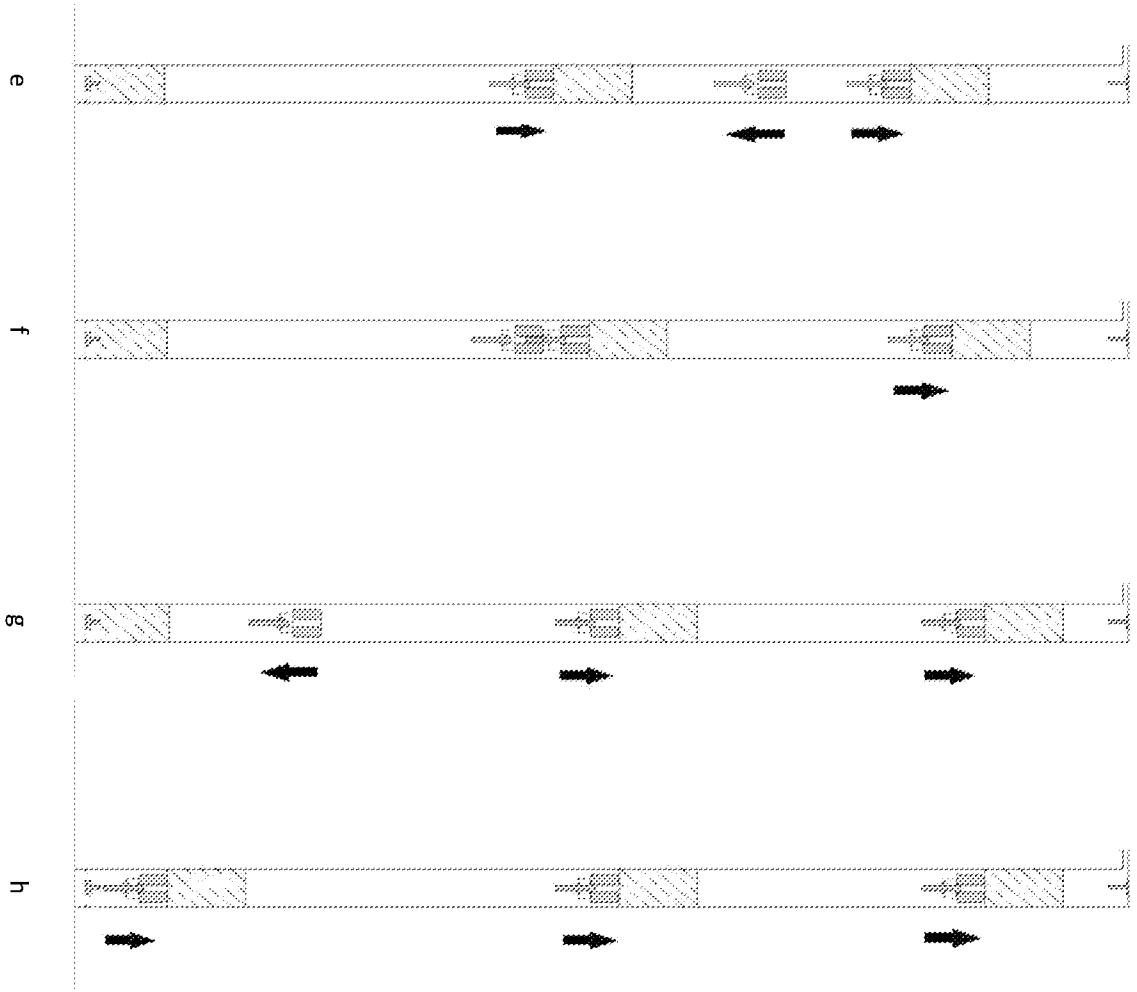
FIG. 5 is a schematic diagram of a working schematic diagram of a liquid drainage system of the present invention.

As shown in FIGS. 4-5.

The liquid drainage method of the multi-plunger cooperated gas lift liquid drainage system provided by this embodiment comprises the following steps:

within the tubing string 1, liquid is accumulating at the bottom of the tubing string 1. when the liquid drainage system is in operation, the gas and the accumulated liquid, both at the bottom of the tubing string 1, are divided into multiple sections by the plurality of plungers 2, the plunger 2 plays a role in sealing both the gas and the liquid to prevent the gas from flowing upward and the liquid from falling back, and then the plungers 2 and the liquid column on the plungers 2 are pushed upward by gas lift.

First, mount the tubing stop 11 on the bottom of the tubing string 1; open the well to a production flow for allowing liquid and gas continuously to accumulate at the bottom of the tubing string 1, and then drop a first plunger 2*a* with a first valve spool 22*a* in an open position, which is the lowest plunger 2, into the tubing string 1; wherein when the first plunger 2*a* falls into the accumulated liquid thereunder, the accumulated liquid flow upward to an upper position above the first plunger 2*a* through the screen apertures 211, valve seat hole 202 and through hole 201 of the first plunger 2*a*, and the first plunger 2*a* continues to pass through the accumulated liquid until it collides with the tubing stop 11, and then the first valve spool 22*a* is closed (changing from the open position to the closed position), the first plunger 2*a* get an sealing function, so that the gas continuously generated at the bottom of the tubing string 1 pushes the first plunger 2*a* and the liquid column on the first plunger 2*a* upward.

When the first plunger 2*a* rises to a first certain height, drop a second plunger 2*a* with a second valve spool 22*a* in the open position into the tubing string 1. Wherein the second plunger 2*b* passes through a gas column and the liquid column pushed by the first plunger 2*a* until it collides with the first plunger 2*a*. Because its weight is light, the second valve stem 23 is pushed in the opposite direction, i.e. up, by the first plunger 21, until a second valve spool 22*b* connected with the second valve stem 23 buckles into the valve seat hole 202 located in the valve body 20 of the second plunger 2*b*, and then the second valve spool 22*b* of the second plunger 2*b* is closed, and at this time, the second plunger 2*b* gets a sealing function, the second plunger 2*b* abuts against the first valve spool 22*a* of the first plunger 2*a* under the effect of inertia to open the first valve spool 221. The first plunger 21 with the first valve spool 221 opened loses the sealing function, the gas produced at the bottom of the tubing string 1 flows to a position below the second plunger 2 through the screen apertures 211, valve seat hole 202 and through hole 201 of the first plunger 2*a*, and pushes the second plunger 2*b* and the liquid column thereon to move upward, the second plunger 2*b* and the first plunger 2*a* complete the load transfer, meanwhile, the first plunger 2*a* falls down under the effect of gravity, then the first plunger 2*a* collides with the tubing stop 11 to close the first valve spool 22*a*. Under the gas lift, the first plunger 2*a* will pushes the liquid column in tubing string 1 upward again. At this time, two small-section liquid columns in the tubing string 1 is pushed upward by two gas columns because of the sealing function of the two plungers.

when the second plunger 2*b* rises to a second certain height, drop a third plunger 2*c* with a third valve spool 22*c* in the open position into the tubing string 1. In the same way, the third plunger 2*c* meets the second plunger 2*b* to transfer the liquid load, then the third valve spool 22*c* of the third plunger 2*c* is closed and the third plunger 2*c* reverses to push the liquid column thereon upward, the second valve 22*b* of second plunger 2*b* opens and the second plunger 2*c* reverses to move downward, and then the second plunger 2*b* meets the rising first plunger 2*a* again to transfer the liquid load, the second valve spool 22*b* of the second plunger 2*b* closes and the second plunger 2*b* reverses and pushes the liquid column above it upward, meanwhile, the first valve 22*a* of the first plunger 2*a* opens and the first plunger 2*a* reverses to move downward until it collides with the tubing stop 11 to close the first valve 22*a*, then the liquid column will again be pushed upward by the gas, at this time, three small-section liquid columns are formed in the tubing string 1 and pushed upward by three gas columns depending on the sealing effect of three plungers 2.

Each time when a previous plunger 2 rises to a certain height, drop a next plunger 2 into the tubing string 1, liquid loads are sequentially transferred between the plungers 2, so that multiple sections of liquid columns and gas columns are formed in the tubing string 1 and move upward simultaneously. The number of the plungers required is determined according to the actual situation.

Install a wellhead poke rod 10 at the wellhead of the tubing string 1. after the liquid column on the uppermost plunger 2 reaches the wellhead and is discharged out of the wellhead, the valve spool 22 of the uppermost plunger 2 is opened by the wellhead poke rod 10 installed at the wellhead, the center hole of the uppermost plunger 2 is unblocked and no longer has a sealing effect, and the uppermost plunger 2 reverse to move downward under the action of gravity, and at the moment, the liquid columns, the plungers 2 and the gas columns below the uppermost plunger 2 continue to move upward.

The uppermost plunger 2 falls down until it collides with a plunger thereunder and transfer an liquid load, the plunger 2 below the uppermost plunger 2 again moves upward and transfer an liquid load with a plunger 2 thereunder, by analogy, the plungers 2 in the tubing string 1 begin another round of liquid load transfer, the plungers 2 transfer liquid loads with each other continuously, therefore, the system runs reciprocating cycle, the plurality of plungers move up and down cooperatively in the tubing string 1 to transfer liquid loads, the liquid columns are discharged step by step.

After the installation is completed, the system can continuously run in the well for a long time.

According to the multi-plunger cooperated gas lift liquid drainage system and liquid drainage method provided by this disclosure, the liquid drainage system circularly runs in a reciprocating manner, a plurality of plungers respectively move up and down in the tubing string 1, and work cooperatively to transferred liquid loads therebetween, every time a small section of liquid column is discharged, the pressure created by this liquid column disappears, the gas column pressure of all stages below the discharged one is reduced, the gas columns expand step by step, the gas expansion can accelerate the ascending motion of the plungers and the liquid columns above the plunger, such that the gas expansion energy is fully utilized, the required gas-liquid ratio is reduced, the liquid discharge amount increases, more liquid can be discharged under the condition that the gas amount is the same, or the gas amount required by the liquid discharging system is greatly reduced under the condition that the liquid discharging amount is the same.

Embodiment 2

Based on embodiment 1, an anti-disengagement spring 221 is arranged in a blind via 223 formed on the outer surface of the valve spool 22, anti-disengagement boss 222 is arranged at the tail end of the anti-disengagement spring 221, an anti-disengagement hole 2021 matched with the anti-disengagement boss 222 to prevent the valve spool 22 from falling off is arranged on the inner surface of the valve seat hole 202. The structure above mentioned can improve the operational stability of the system, and also improve the fault tolerance rate: without the structure, the valve body 20 meets with the valve spool 22 and forms a sealed structure under the action of pressure, so that liquid discharging work can be well completed, and under the condition that the sealed structure has certain defects, the anti-disengagement spring 221 can bear part of pressure, so that the stability of the whole liquid discharging system is guaranteed.

The number of the anti-disengagement spring 221 can be multiple and the anti-disengagement springs 221 evenly distributed on the outer surface of the valve spool 22, the number of the anti-disengagement holes 2021 is consistent with the number of the anti-disengagement springs 221, the anti-disengagement springs 221 are evenly distributed on the outer surface of the valve spool 22, and the stability of the system can be further improved through the arrangement of the multiple structures.

Embodiment 3

Based on embodiment 1, the gas accumulated at the bottom of the tubing string 1 is a reservoir gas continuously injected from the ground to the bottom of the tubing string 1 through the casing. In the later case, the application of the multi-stage plunger 2 is more important, the gas column expands step by step because of the usage of the multi-stage plunger 2, meanwhile, the rising movement of the plungers 2 and the liquid column above the plungers 2 is accelerated, the required gas-liquid ratio is reduced, the liquid discharging amount increases, the gas amount required by the liquid discharging system is greatly reduced under the condition that the liquid discharging amount is the same, and more manpower and physical cost can be saved.

Embodiment 4

Based on embodiment 1, the present embodiment reasonably utilizes the leakage condition of the plungers 2, and in the installation process of the liquid drainage system, the tubing stop 11 can be installed first, all the plungers 2 can be dropped into the tubing string 1 at one time, and then install the wellhead poke rod 10, that is, after the installation is completed, open the well for production, liquid and gas are distributed between the plungers respectively, and the system operates as usual. According to the embodiment, the time for dropping the plungers 2 can be saved, and the method is a better scheme.

The foregoing description is merely a specific embodiment of the present disclosure, but the protection scope of the present disclosure is not limited thereto, any variation or replacement made by one of ordinary skill in the related art without departing from the scope of the present disclosure should falls with the protection scope of the present disclosure. Therefore, the protection scope of the present invention shall be subject to the protection scope of the claims.

What is claimed is:

1. A liquid drainage method of a multi-plunger cooperated gas lift liquid drainage system, the multi-plunger cooperated gas lift liquid drainage system comprising: a tubing string and a plurality of plungers arranged in the tubing string successively from top to bottom; wherein a wellhead poke rod is arranged at a top of the tubing string, a tubing stop is arranged at a bottom of the tubing string;

each of the plurality plungers comprising a valve body, a cavity fluidly communicated with a lower end of the valve body, a valve spool disposed in the cavity, and a valve stem passing through a bottom wall of the cavity and fixedly connected to a lower end of the valve spool;

a through hole penetrating through an upper wall of the valve body and formed in the valve body wherein a lower end of the through hole is fluidly communicated with a valve seat hole, the valve seat hole penetrates through the lower end of the valve body;

the liquid drainage method comprising following steps:

Step 1: installing the tubing stop on a lower portion of the tubing string in a well; opening the well for allowing liquid and gas to flow in and accumulate at a bottom of the tubing string;

dropping a first plunger with a first valve spool in an open position into the tubing string, wherein the first plunger falls through an accumulated liquid while the accumulated liquid is flowing to an upper position above the first plunger, and collides with the tubing stop to close the first valve, the first plunger gets itself sealed when the first valve spool is closed, and then the first plunger and an upper accumulated liquid thereon is pushed upward by the gas accumulated at the bottom of the tubing string;

Step 2: when the first plunger rising to a first certain height, dropping a second plunger with a second valve spool in an open position into the tubing string, wherein the second plunger falls through an upper accumulated liquid on the first plunger to collide with the first plunger, causing the first valve spool to be opened, the second valve spool to be closed, the upper accumulated liquid on the first plunger to transfer to an upper position above the second plunger, and the second plunger and an accumulated liquid thereon to be pushed upward by a second gas column, the first plunger loses the sealing function due to the first valve spool opened and falls to the tubing stop to reclose the first valve spool under an influence of gravity, a newly formed liquid column at the tubing stop is pushed again to ascend under the action of the gas accumulated at the bottom of the tubing string, and at this moment, two small-section liquid columns are formed in the tubing string and pushed upward by two gas column sections the sealing effect of the two plungers;

Step 3: when the second plunger rising to a second certain height, dropping a third plunger with a third valve spool in an open position, wherein the third plunger meets the second plunger to transfer a liquid load, close the third valve spool, and open the second valve spool, the third plunger reverses and pushes a liquid column thereon upward, the second plunger reverses and moves downward, and then the second plunger meets the first plunger to transfer a liquid load, close the second valve spool, and opens the first valve spool, the second plunger reverses and pushes a liquid column thereon upward, the first plunger reverses to move downward, collides with the tubing stop to close the first valve spool, and again pushes a liquid column thereon upward, at this moment, three small-section liquid columns are formed in the tubing string and pushed upward by three gas column sections under the sealing effect of the three plungers;

Step 4: each time when the first plunger rising of the plurality of plungers to a certain height, dropping the second plunger of the plurality of plungers which is next to the first plunger into the tubing string, and so on, until the last plunger of the plurality of plungers rising to a last certain height, liquid loads are sequentially transferred between the plungers, so that multiple liquid column sections and multiple gas column sections are formed in the tubing string and move upward simultaneously; wherein the plurality of plungers is determined according to actual needs of the well;

Step 5: installing a wellhead poke rod at a wellhead of the tubing string; wherein an uppermost plunger moves upward to the wellhead with an accumulated liquid and gas on the uppermost plunger being discharged from the tubing string, collides with the wellhead poke rod to open its valve spool, and falls downward;

Step 6: allowing the uppermost plunger to falls down, wherein the uppermost plunger collides with a plunger thereunder and transfer a liquid load, the uppermost plunger again moves upward to push an accumulated liquid thereon and gas above itself out of the tubing string, the plunger below the uppermost plunger falls downward, the plungers collide with each other to sequentially transfer liquid loads, by analogy, the system runs reciprocating cycle to discharge an accumulated liquid and gas produced at the bottom of the tubing string, every time a small section of liquid column and gas column are discharged, the pressure of all gas columns in the tubing string is reduced, and the gas columns expand stage by stage, act as a driving force together with the gas produced at the bottom of the well, to push the liquid columns at all stages upward.

2. The liquid drainage method according to claim 1, wherein the gas accumulated at the bottom of the tubing string is a reservoir gas continuously injected from the ground into the bottom of the tubing string through a sleeve.

3. The liquid drainage method according to claim 1, comprising flowing steps: installing the tubing stop at a bottom of a tubing string in a well, dropping all plungers into the tubing string at one time, installing a wellhead poke rod at a top of the tubing string, and then opening the well for production.

* * * * *